US006562249B2

(12) United States Patent
Eshleman et al.

(10) Patent No.: US 6,562,249 B2
(45) Date of Patent: May 13, 2003

(54) METHOD UTILIZING A MAGNETIC ASSEMBLY DURING ETCHING THIN SHADOW MASKS

(75) Inventors: Craig Clay Eshleman, Pequea, PA (US); Charles Michael Wetzel, Lititz, PA (US); Randall Eugene McCoy, Fort Littleton, PA (US); Leo B. Kriksunov, Ithaca, NY (US); Lance Benjamin, LaFayette, NY (US); Derek Harris, Woodbury, MN (US); Thomas R. Sage, Endwell, NY (US)

(73) Assignees: BMC Industries, Inc., Minneapolis, MN (US); Thomson Consumer Electronics, Indianapolis, IN (US)

( * ) Notice: Subject to any disclaimer, the term of this patent is extended or adjusted under 35 U.S.C. 154(b) by 0 days.

(21) Appl. No.: 09/902,456

(22) Filed: Jul. 10, 2001

(65) Prior Publication Data

US 2002/0070196 A1 Jun. 13, 2002

Related U.S. Application Data

(63) Continuation of application No. 09/330,697, filed on Jun. 11, 1999, now abandoned.

(51) Int. Cl.[7] ..... C25F 3/00

(52) U.S. Cl. ..... 216/12; 248/683; 414/606; 134/41; 335/285

(58) Field of Search ..... 156/345; 216/12; 248/683; 414/606; 134/41; 335/285

(56) References Cited

U.S. PATENT DOCUMENTS

| | | | | |
|---|---|---|---|---|
| 2,822,635 A | 2/1958 | Mears | ..... | 41/9 |
| 3,959,874 A | 6/1976 | Coucoulas | ..... | 29/577 |
| 4,357,196 A | 11/1982 | Tanaka et al. | ..... | 156/345 |

FOREIGN PATENT DOCUMENTS

| | | | | |
|---|---|---|---|---|
| EP | 0 642 148 B1 | 12/1998 | ..... | H01J/9/14 |
| FR | 2 668 091 | 4/1992 | ..... | B23Q/3/152 |
| JP | 60 200440 | 10/1985 | ..... | H01J/29/07 |
| JP | 11 152587 | 6/1989 | ..... | C23F/1/00 |
| JP | 06 41769 | 2/1994 | ..... | C23F/1/08 |

OTHER PUBLICATIONS

Merriam–Webster's Collegiate Dictionary. 10–th edition, 1998. p. 1230.*

Patent Abstracts of Japan, vol. 010, No. 046 (E–383), Feb. 22, 1986, (Toshiba KK).

Patent Abstracts of Japan, vol. 1999, No. 11, Sep. 30, 1999 (Toppan Printing Co. Ltd).

Patent Abstracts of Japan, vol. 018, No. 271 (C–1203) May 24, 1994 (Dainippon Screen Mfg. Co. Ltd).

* cited by examiner

*Primary Examiner*—Randy Gulakowski
*Assistant Examiner*—M. Kornakov
(74) *Attorney, Agent, or Firm*—Mark A. Litman & Assoc. P.A.

(57) ABSTRACT

In an improved method of etching apertures in a thin metal sheet to form a shadow mask for a color picture tube, the metal sheet has a first acid-resistant stencil on one major surface thereof and a second acid-resistant stencil on the other major surface thereof. At least one of the stencils has openings therein at locations of intended apertures. The improvement comprises the steps of magnetically holding the metal sheet with a flat magnetic assembly, and moving the magnetic assembly magnetically holding the metal sheet thereon through an etching chamber. The magnetic assembly includes a magnetic layer that is supported on an acid-resistant board.

2 Claims, 5 Drawing Sheets

METHOD UTILIZING A MAGNETIC ASSEMBLY DURING ETCHING THIN SHADOW MASKS

This Application is a continuation of U.S. patent application Ser. No. 09/330,697, filed Jun. 11, 1999.

This invention relates to a method of etching apertures in a thin metal sheet to form a shadow mask for a color picture tube, and particularly to such a method that utilizes a magnetic assembly during etching of a thin tension shadow mask, to magnetically hold the mask material.

BACKGROUND OF THE INVENTION

A color picture tube includes an electron gun for generating and directing three electron beams to the screen of the tube. The screen is located on the inner surface of a faceplate of the tube and is made up of an array of elements of three different color emitting phosphors. A color selection electrode, or shadow mask, is interposed between the gun and the screen to permit each electron beam to strike only the phosphor elements associated with that beam. A shadow mask is a thin sheet of metal, such as steel or Invar, that is usually contoured to somewhat parallel the inner surface of the tube faceplate.

One type of color picture tube has a tension shadow mask mounted within a faceplate panel thereof. The tension shadow mask includes an active apertured portion that contains a plurality of parallel vertically extending strands. A multiplicity of elongated apertures are located between the strands. The electron beams pass through the elongated apertures in the active portion during tube operation.

Handling of tension shadow masks during their manufacture can be very difficult, especially if there are no tie bars or other connections between the strands of the mask. For example, if a tension shadow mask were etched by the process used to make conventional domed masks, there would be excessive movement of the strands during etching, and therefore great difficulty in obtaining repeatable results. The present invention provides a method that utilizes a magnetic assembly to overcome the difficulties that may arise during etching of tension shadow masks.

SUMMARY OF THE INVENTION

The present invention provides an improvement in a method of etching apertures in a thin metal sheet to form a shadow mask for a color picture tube. The metal sheet has a first acid-resistant stencil on one major surface thereof and a second acid-resistant stencil on the other major surface thereof. At least one of the stencils has openings therein at locations of intended apertures. The improvement comprises the steps in the etch method of magnetically holding the metal sheet with a flat magnetic assembly, and moving the magnetic assembly magnetically holding the metal sheet thereon through an etching chamber. The magnetic assembly includes a magnetic layer that is supported on an acid-resistant board.

DETAILED DESCRIPTION OF THE PREFERRED EMBODIMENT

Figure 1:
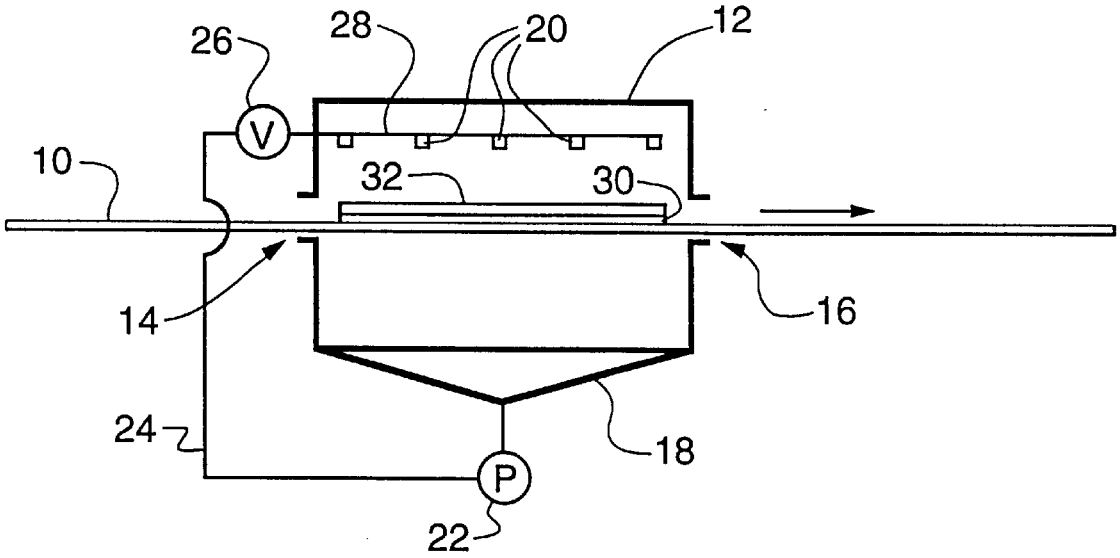
FIG. 1 is a schematic representation of an apparatus that may be used for practicing a first embodiment of the novel method.

FIG. 1 shows a horizontally oriented insulative strip 10, while it is moving left-to-right through an etching chamber 12. The etching chamber 12 has an entrance port 14 and an exit port 16. A sump 18 is located at the bottom of the chamber 12 to collect a liquid etchant emitted from spray nozzles 20 positioned at the top of the chamber. The etchant in the sump 18 is pumped by a pump 22 through piping 24, which includes a control valve 26, to a header 28 to which the nozzles 20 are attached. A flat magnetic assembly 30 is shown on the top of the strip 10 within the chamber 12. On top of the magnetic assembly 30 is a metal sheet 32 used to produce a shadow mask.

Figure 2:
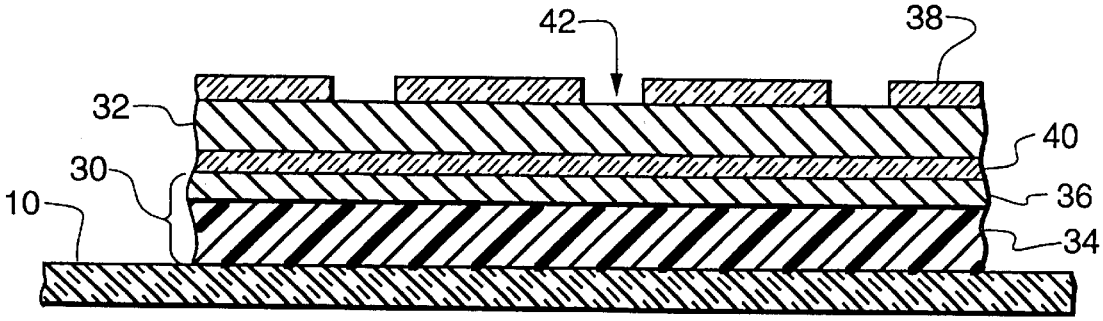
FIGS. 2 and 3 are cross-sections of a magnetic assembly and metal sheet at different stages of practicing the first embodiment of the novel method.
Figure 3:
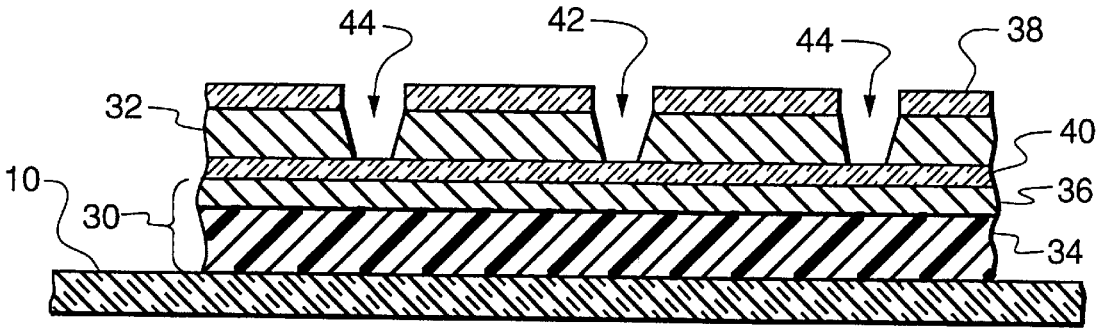

As shown in FIG. 2, the magnetic assembly 30 is an insulative circuit board material 34 that includes a thin magnetic layer 36 adhered thereto. The metal sheet 32 includes an upper first acid-resistant stencil 38 on one major surface thereof and a lower second acid-resistant stencil 40 on the other major surface thereof. The upper stencil 38 has openings 42 therein at locations of intended apertures in the completed shadow mask. The magnetic assembly 30 and metal sheet 32 are kept in the etching chamber 12 a sufficient time to ensure that apertures are completely etched through the sheet. FIG. 3 shows the magnetic assembly 30 and the metal sheet 32 after they have left the etching chamber 12, with complete apertures 44 formed in the metal sheet 32.

Figure 4:
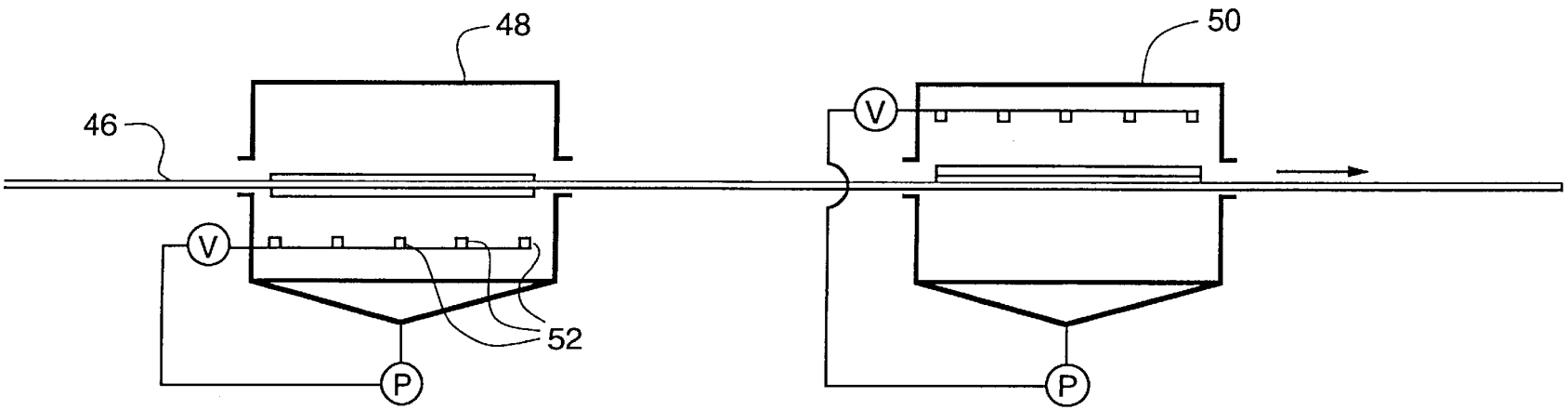
FIG. 4 is a schematic representation of an apparatus that may be used for practicing a second embodiment of the novel method.

In another embodiment, shown in FIG. 4, an insulative strip 46 passes through two etching chambers 48 and 50. The construction of the second chamber 50 is similar to the etching chamber 12 of the previous embodiment. The first chamber 48 differs from the second chamber 50 in that the former includes spray nozzles 52 that spray from below the strip 46 instead of from above. Preferably, the insulative strip 46, as well as the strip 10 of the first embodiment, is moved continuously during etching.

Figure 5:
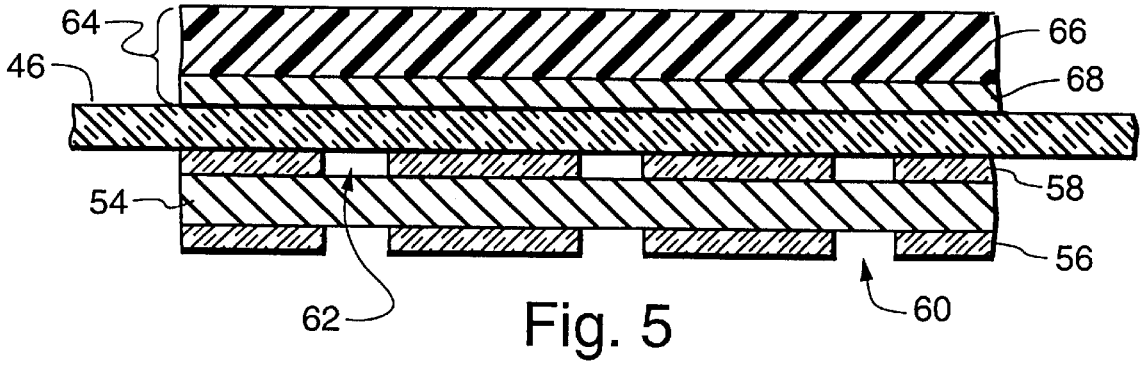
FIGS. 5 through 9 are cross-sections of two magnetic assemblies and a metal sheet at different stages of practicing the second embodiment of the novel method.
Figure 6:
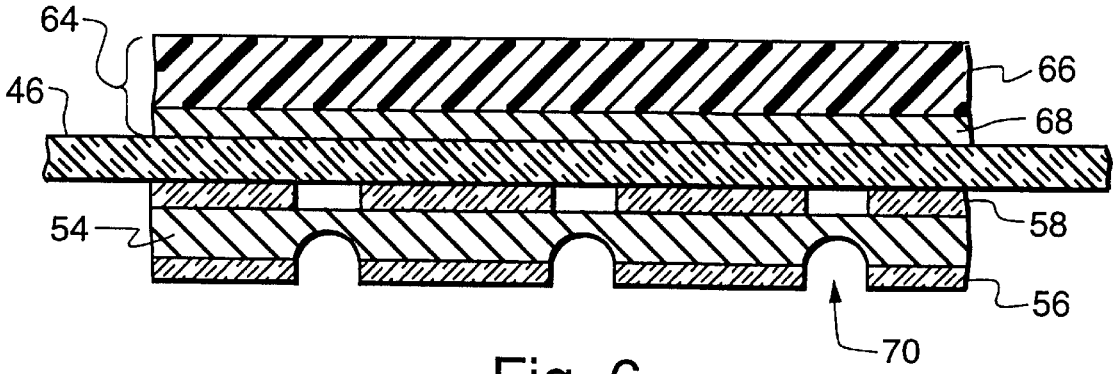
Figure 7:
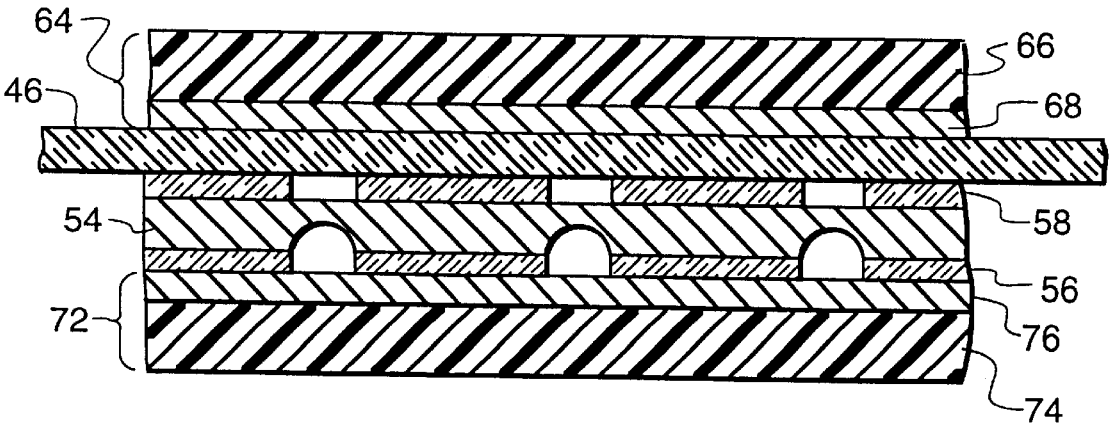
Figure 8:
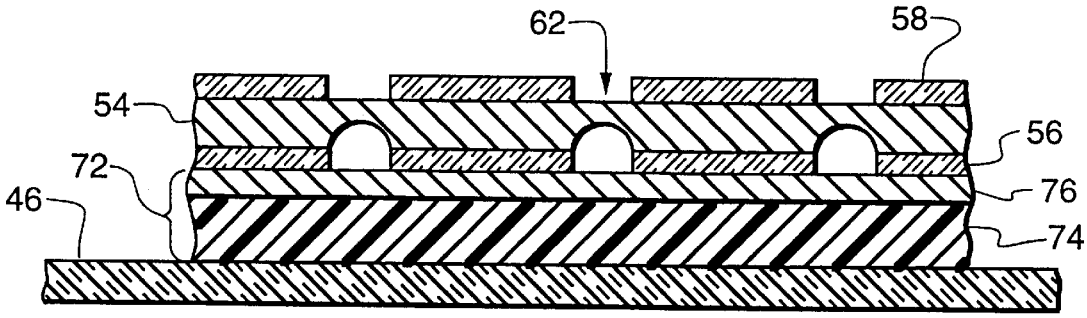
Figure 9:
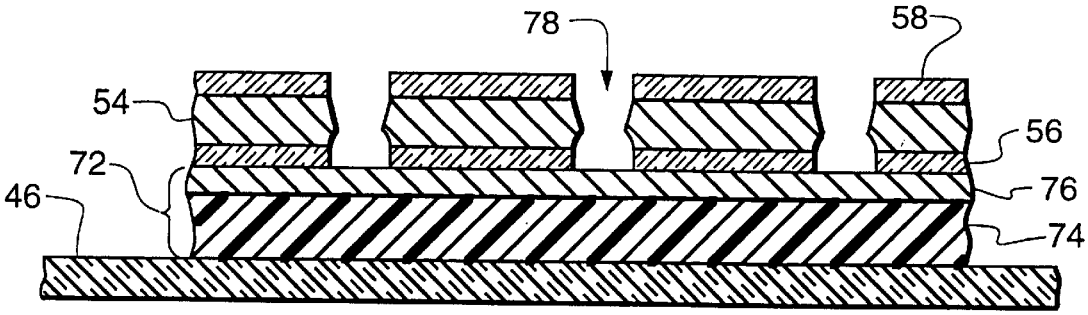

FIG. 5 Shows a metal sheet 54 including a lower first acid-resistant stencil 56 on one major surface thereof and an upper second acid-resistant stencil 58 on the other major surface thereof. Both stencils 56 and 58 have openings 60 and 62, respectively, at locations of intended apertures In the completed shadow mask. At the beginning of the etch process, the metal sheet 54 is magnetically held against the bottom of the strip 46 by magnetic assembly 64 that includes an insulative circuit board material 66 with a thin magnetic layer 68 attached thereto. Partial apertures 70 are etched in the metal sheet 54 in the first chamber 48 to depth of about 40% of the thickness of the sheet, as shown in FIG. 6. After the magnetic assembly 64 and the metal sheet 54 leave the first chamber 48, a second magnetic assembly 72, including an insulative circuit board material 74 with a thin magnetic layer 76 attached thereto, is placed against the lower side of the metal sheet 54, as shown in FIG. 7. Next, the first magnetic assembly 64 is removed from the top of the strip 46 and the second magnetic assembly 72, with the metal sheet 54 magnetically attached, is placed on top of the strip 46, as shown in FIG. 8. The metal sheet 54 then enters the second etching chamber 50 with the second acid-resistant stencil 58 facing upward. The metal sheet 54 is etched through to the partial apertures 70, thus forming final apertures 78, as shown in FIG. 9. Following etching, the acid-resistant stencils are removed, and the remaining metal sheet 54 is a shadow mask.

The magnetic layers 36, 68 and 76 preferably are continuous rectangles that are at least as large in area as the metal sheets 32 and 54. Alternatively, the magnetic layers could be magnetic strips aligned parallel with the direction of movement through the chambers. For example, a magnetic assembly was constructed with magnetic strips running parallel to the direction of movement through the etching chamber that were attached to a G-10 stripped circuit board sheet. In this case the circuit board material was chosen because of its small thermal expansion coefficient and because of its resistance to etching solutions used to make the mask. Preferably, the magnetic strips are positioned outside the active area of the masks to allow for solution exchange during etching to avoid staining. The magnets hold the mask material to prevent excessive movement of the material during etching, and to permit handling of the mask without the chance of any tangling of mask strands or other mask damage occurring. Also, additional magnet members can be used on top of the metal sheet to further hold the mask in place during etching and to prevent any contact with the mask by the etching equipment.

What is claimed is:

1. A method of etching apertures in a thin metal sheet to form a shadow mask for a color picture tube, said thin metal sheet having a first acid-resistant stencil on one major surface thereof and a second acid-resistant stencil on the other major surface thereof, both said first acid-resistant stencil and said second acid-resistant stencil having openings therein at locations of intended apertures in said sheet, said method comprising:

magnetically holding said thin metal sheet with a flat magnetic assembly, said flat magnetic assembly including a magnetic layer that is supported on an acid-resistant board, moving said flat magnetic assembly through an etching chamber while said flat magnetic assembly magnetically holds said thin metal sheet thereto, said etching chamber having an insulative strip passing therethrough, said thin metal sheet being positioned under said insulative strip with said first acid-resistant stencil facing downward, said magnetic assembly being located on top of said insulative strip with said magnetic layer facing downward to magnetically hold said metal sheet against said insulative strip, as said insulative strip, with magnetic assembly and metal sheet thereon, is moved through said etching chamber, partially etching into the metal sheet from the bottom side thereof to form a partially etched metal sheet, transferring said partially etched metal sheet to a second magnetic assembly which magnetically holds it thereto, placing said second magnetic assembly on the top of said insulative strip with the second acid-resistant stencil on said metal sheet facing upward, and passing said second assembly and metal sheet through a second etching chamber, wherein etch-through of apertures in said metal sheet is completed.

2. A method of etching apertures in a thin metal sheet to form a shadow mask for a color picture tube, said metal sheet having a first acid-resistant stencil on one major surface thereof and a second acid-resistant stencil on the other major surface thereof, both of said stencils having openings therein at locations of intended apertures in said sheet, said method including the steps of:

magnetically holding said metal sheet with a magnetic assembly, moving said magnetic assembly through an etching chamber, while said magnetic assembly magnetically holds said metal sheet thereto, said etching chamber having an insulative strip passing therethrough, said metal sheet being positioned on one side of said insulative strip with said first acid-resistant stencil facing spray nozzles, said magnetic assembly being located on an opposite side of said insulative strip with said magnetic layer magnetically holding said metal sheet against said insulative strip, as said insulated strip with magnetic assembly and metal sheet thereon, is moved through said etching chamber, partially etching into the metal sheet from the first acid-resistant stencil side thereof to form a partially etched metal sheet, transferring said partially etched metal sheet to a second magnetic assembly which magnetically holds it thereto, placing said second magnetic assembly on said insulative strip with the second acid-resistant stencil on said metal sheet facing spray nozzles, and passing said second assembly and metal sheet through a second etching chamber, wherein etch-through of apertures in said metal sheet is completed.

* * * * *